US007225541B2

(12) United States Patent
Kubota

(10) Patent No.: US 7,225,541 B2
(45) Date of Patent: Jun. 5, 2007

(54) METHOD FOR PRODUCING HOLLOW RACK BAR

(76) Inventor: Chiaki Kubota, 28 Kakita, Shimizu-cho, Suntou-gun, Shizuoka-ken (JP)

( * ) Notice: Subject to any disclaimer, the term of this patent is extended or adjusted under 35 U.S.C. 154(b) by 230 days.

(21) Appl. No.: 10/679,341

(22) Filed: Oct. 7, 2003

(65) Prior Publication Data

US 2005/0072002 A1 Apr. 7, 2005

(51) Int. Cl.
*B21K 21/16* (2006.01)
*B21D 51/16* (2006.01)

(52) U.S. Cl. ..... 29/897.2; 29/DIG. 18; 72/356; 72/370.06; 72/370.21; 72/370.14; 72/370.25; 74/422

(58) Field of Classification Search ..... 29/897, 29/897.2, DIG. 18, DIG. 19, 893.34; 72/264, 72/276, 352, 356, 357, 372, 370.01, 370.04, 72/370.13, 370.14, 370.15, 370.21, 370.23, 72/370.24, 370.25; 74/422
See application file for complete search history.

(56) References Cited

U.S. PATENT DOCUMENTS

| | | | | |
|---|---|---|---|---|
| 4,133,221 | A * | 1/1979 | Clary | 74/498 |
| 4,598,451 | A * | 7/1986 | Ohki | 29/893.3 |
| 6,289,710 | B1 * | 9/2001 | Ozeki | 72/370.04 |
| 6,442,992 | B2 * | 9/2002 | Tsubouchi et al. | 72/370.21 |
| 6,494,073 | B2 * | 12/2002 | Oka et al. | 72/356 |
| 6,575,009 | B2 * | 6/2003 | Shiokawa | 72/370.06 |
| 6,718,813 | B2 * | 4/2004 | Yasuda et al. | 72/370.04 |
| 6,925,899 | B2 * | 8/2005 | Ozeki | 74/422 |
| 2001/0006000 | A1 * | 7/2001 | Oka et al. | 72/356 |

FOREIGN PATENT DOCUMENTS

| | | | |
|---|---|---|---|
| GB | 2026908 | A * | 2/1980 |
| GB | 2061138 | A * | 5/1981 |
| JP | 56062734 | A * | 5/1981 |
| JP | 58081535 | A * | 5/1983 |
| JP | 63212175 | A * | 9/1988 |
| JP | H03-005892 | | 1/1991 |
| JP | H05-169181 | | 7/1993 |
| JP | H06-246379 | | 9/1994 |
| JP | 2001-300677 | | 10/2001 |

* cited by examiner

*Primary Examiner*—Jermie E. Cozart
(74) *Attorney, Agent, or Firm*—Ditthavong Mori & Steiner, P.C.

(57) ABSTRACT

A method for forging a rack bar from a blank pipe. Prior to the rack forging process, a blank pipe is subjected to a process for obtaining an adjustment of a cross-sectional shape of the blank pipe. Such a preliminary adjustment is constructed by a swaging process for reducing an outer diameter of the blank pipe and a ironing process for obtaining a desired irregular cross-sectional shape of the blank pipe. The ironing process is such that locally thickened wall portions are obtained at length wise ends as well as tooth width ends of a rack forging die.

3 Claims, 7 Drawing Sheets

METHOD FOR PRODUCING HOLLOW RACK BAR

BACKGROUND OF THE INVENTION

1. Field of the Invention

The present invention relates to a method and apparatus for forging, from a metal pipe, a rack bar, which is used for a steering apparatus in an automobile et al.

2. Description of Related Art

A rack bar as a part for a steering apparatus of an automobile is conventionally produced from a solid rod member by a machining such as a broaching. However, such a conventional rack bar is defective in an increased weight due to its solid structure. Furthermore, a rack bar of varied gear ratio (VGR) cannot be obtained by the broaching since a machining of toothed portions of varied width is impossible by the broaching.

In view of the above, in order to reduce a weight as well as to obtain a varied gear construction, a formation of a hollow rack bar from a blank pipe produced from a forging process has recent been proposed. See Japanese Un-examined Patent Publication (Kokai) No. 3-5892, Japanese Un-examined Patent Publication (Kokai) No. 5-169181 or Japanese Un-examined Patent Publication (Kokai) No. 6-246379 or Japanese Un-examined Patent Publication (Kokai) No. 2001-300677.

When a forging of a hollow rack bar is done, a blank pipe is held by a toothed die. Then, a mandrel is, under a pressure, inserted to the blank pipe held by the die, so that a radial expansion of the metal (plastic flow of metal material) is generated toward toothed portions, thereby forming a rack bar. Thus, a desired control of the cross-sectional area is essentially needed in order to obtain a desired precision of the rack bar. However, blank pipes supplied from manufacturers are, as far as their values of a inner and outer diameters are concerned, merely controlled in a range of tolerance under a government regulation, such as a Japanese Industrial Standard (JIS). Thus, a precision of these blank pipes as for the forging of rack bars are insufficient, resulting in a variation in the flow of metal as well as in an increased forming force during the execution of the forging process. Thus, a production efficiency is reduced, on one hand and, on the other hand, a service life of tools (dies) is reduced due to the excessive load occurred therein during the execution of the working.

The prior art method for producing a rack bar is defective in view of difficulties in a subsequent hardening process. Namely, in a usual hardening process, a rack bar is held by a die only at an outer diameter side. In this case, no restriction of escape of thermal distortion toward the inner diameter side is possible. Furthermore, an insertion of a core is not effective for obtaining a desired precision because of a reduced precision of an inner diameter of a blank pipe within a tolerance. As a result, a specially designed technique is required for executing the hardening of the hollow rack bar, which causes the hardening process to be time consuming, on one hand and, on the other hand, causes the production cost to be increased. Furthermore, in a rack forging process, a metal flow is likely generated in the direction where a moving distance is short, i.e., the flow of metal is easy. As a result, when a mandrel of a simplified uniform cross-sectional type is used in a rack forging process, a locally excessive or locally shortened flow of the metal to a toothed die is likely generated, resulting in reduced performances. In view of this, an improvement has been proposed, wherein a plurality of mandrels of non-uniform shapes are provided for obtaining non-uniformed flows of metal. However, this improved process is defective due to its increased cost, on one hand and, on the other hand, its inability of possibility in the adjustment of metal flow in the axial direction.

SUMMARY OF THE INVENTION

An object of the present invention is to overcome the above-mentioned drawbacks encountered in the prior arts.

Another object of the invention is to increase a precision of the product while enhancing a service life of working tools.

Further another object of the present invention is to reducing a production cost of a rack bar.

According to an aspect of the present invention, a method for forging a hollow rack bar from a metal blank pipe, comprising the steps of:

(a) subjecting the blank pipe to a plastic deformation process for an adjustment of a cross-sectional shape of the metal blank pipe;

(b) holding said adjusted metal blank pipe by a die having toothed portions so that the toothed portions are contacted with the blank pipe at its outer surface, and;

(c) inserting, under a pressure, a mandrel into the blank pipe held by the die for causing the metal to be flown toward toothed portions, thereby forming on the outer surface of the blank pipe toothed portions having shapes corresponding to those of the toothed portions of the die.

In an operation of the above aspect of the invention, a forging of a hollow rack bar is obtained by inserting a mandrel into a blank pipe held by a die having toothed portions. The insertion of the mandrel causes the metal to be subjected to a plastic deformation, i.e., the metal to be flown toward the die. According to the first aspect of the invention, prior to the execution of the forging process, the blank pipe is subjected to a plastic working for an adjustment of the cross-sectional shape of the blank pipe. Due to such an adjustment of the cross-sectional shape of the blank pipe, an idealized flow of the metal toward the die is obtained, resulting in an increased precision of final products as fine as several 10 μm in the sense of a tolerance, without necessitating any subsequent machining process. Furthermore, a load applied to the die during the execution of the forging process is greatly reduced, thereby enhancing a service life of the die. Thanks to the strict control of the inner diameter of the blank pipe as fine as several 10 μm as obtained by the preliminary adjustment process, a subsequent hardening process can be executed at a firmly fixed condition of the product while being assisted by an introduction of a core inserted to the hardened product. Furthermore, in order to reduce any distortion as generated during the hardening process, any factors, which might influence to the operating performance, can be suitably adapted, such as a shape, a dimensional tolerance and material of the insertion core, a shape of high frequency coil and a frequency, a magnetic flux density and an eddy current applied to the high frequency coil. Such an adaptation allows desired hardened products to be obtained under a reduced production cost.

Preferably, in the adjusting step, the cross-sectional shape of the blank pipe is adjusted to a predetermined shape including a circular or irregular cross-sectional shape. In the invention, an insertion of the mandrel causes the metal to be flown into the toothed die, resulting in a formation of a rack bar. In this formation process, the metal at the inner diameter side at the ends of the axial movement is likely flown to freed areas of reduced distance and of reduced flow resistance in a length wise or tooth width direction rather than flown into the toothed die, so that an amount of the metal in the die is likely lacked, resulting in a reduction of the precision of the product (rack bar). According to the present invention, prior to the insertion of the mandrel, an adjustment of the cross sectional shape (a cross-sectional area or inner or outer diameter) of the blank pipe to a predetermined shape is done. As a result, a local increase in thickness is obtained, which prevents a metal flow from being lacked at a desired location. Namely, a compensation of a metal flow amount is done, resulting in a desired precision of the product. In a certain situation, a metal expansion is not necessarily even along the entire width. Namely, a reduced tooth width is enough if it is sufficient to mesh with a pinion to obtain a desired force transmission. As a result, it is quite usual that the toothed die has, at its sides along the tooth width, an opened structure. However, by this opened structure, an increased amount of metal is wasted in the direction of the width the metal flow, resulting in a reduced meshing force of the rack bar with a pinion. According to the present invention, a control of the cross-sectional shape of blank pipe is executed by ironing process prior to the rack bar forging, so that a non-uniform cross-sectional shape of the blank pipe is obtained. In other words, a thickness of the blank pipe is locally increased at ends along the length and width, thereby obtaining a desired flow of metal even at the end zone of the die. Thanks to the non-uniform cross-sectional shape, an adaptation to a desired change in the toothed portions becomes possible when a rack bar of a miter gear type or VGR type is to be produced, in which a teeth pitch as well as a tooth width are varied. Furthermore, non-uniform cross-sectional shape according to the present invention is such that a shortage of metal flow at opened ends in the direction of axis and/or a shortage of metal flow at ends of tooth width direction is cancelled. In short, due to this solution of the irregular shape, a uniformly compensated flow resistance of the metal is obtained irrespective use of a single uniform shaped mandrel. In short, according to the present invention, a reduced operating force, an increased service life, an increased precision as well as an increased meshing efficiency are obtained, without using a plurality of irregularly shaped mandrels.

Preferably, the step for the adjustment of the cross sectional shape comprises the steps of: subjecting the blank pipe to swaging process for reducing the diameter of the blank pipe, and; subjecting the said swaged pipe to an ironing process for producing a desired cross-sectional shape of the blank pipe. The swaging for reducing the diameter of the blank pipe followed by the ironing allows the blank pipe to be formed with a desired cross-sectional shape having a desired diameter as well as thickness with locally varied thickness portions, which assists the product precision to be enhanced on one hand and, on the other hand, the service life of the tool to be prolonged.

According to another aspect of the present invention, a method is provided for forging a hollow rack bar from a metal blank pipe, said method comprising a pre-forming step and a main forming step after the execution of the performing step, the pre-forming comprises the steps of:

(a) subjecting the blank pipe to swaging process for reducing the diameter of the blank pipe;

(b) clamping the swaged blank pipe by a clamping die of a desired shape at the outer periphery thereof, while locating an operating head inside the blank pipe, and;

(c) withdrawing the operating head so that the blank pipe is swaged at it inner diameter side, thereby generating a desired shape of the hollow cavity of the blank pipe extending in an axial and radial directions; and said main forming comprises the steps of:

(d) holding the pre-formed blank pipe from its outer side by a rack forming die having toothed portions; and (e) inserting, under a pressure, a mandrel to the inner diameter cavity of the blank pipe, thereby forming on the outer surface of the blank pipe toothed portions having shapes corresponding to those of the rack forming die.

In an operation of this aspect of the invention, a swaging for reducing the diameter is done, which is followed by a withdrawing of the operating head while a clamp die is arranged around the outer periphery, so that a desired adjustment of the blank pipe is obtained as to its outer diameter as well as its cross-sectional shape. As a result, a desired precision is obtained at the subsequent rack bar forming process. Furthermore, a prolonged service life of working tools such as a toothed die is obtained.

According to the further another aspect of the invention, a method is provided, for forging a hollow rack bar from a blank metal pipe, comprising the steps of:

(a) holding said blank pipe by means of a clamping die having, at its inner periphery, toothed portion for forming the rack, and;

(b) inserting, at a pressure, a mandrel into the blank pipe, while, during the insertion, the mandrel causes the metal to be subjected to simultaneous expanding functions at different locations of the toothed portions along the longitudinal direction, thereby forging the blank pipe to a hollow rack bar.

In an operation of this aspect of the invention, a forging is proceeded while a metal is simultaneously flown to different projected or recessed portions of the toothed die, thereby obtaining a highly evened force during the insertion of the mandrel, so that a load applied to the toothed die is relatively reduced, resulting in a prolonged service life of the tool.

According to still another aspect of the invention, an apparatus is provided, for forging a hollow rack bar from a blank metal pipe, comprising:

a die for holding the blank pipe from its outer surface, said die having at its inner surface toothed portions for forming a rack, and;

a mandrel for inserting, at a pressure, into the blank pipe held by the die, said mandrel having enlarged head for causing, during the insertion, the metal to be expanded outwardly toward the toothed portions of the die, so that toothed portions corresponding to those at the die are formed on the outer surface of the blank pipe, said mandrel comprising forging means for causing, during the insertion of the mandrel, the blank pipe to be subjected, at different location along the length, to simultaneous expansive forged actions at different locations of the toothed portions along the length of the mandrel.

In an operation of this aspect of the invention, a forging process is occurred while the mandrel cooperates with different portions (projected and/or recessed portions of the toothed die) for obtaining simultaneous and summed expansion actions, resulting in a uniformed force during the insertion of the mandrel, thereby reducing a load in the mandrel, on one hand and, on the other hand, increasing a service life of the mandrel.

As an alternative, said forging means comprises an operating head and a plurality of grooves on the operating head spaced along the length of the mandrel, said grooves being inclined opposite to the direction of the inclination of the toothed portions of the die. Thanks to a provision of the oil vent grooves inclined in a direction opposite to the direction of the inclination of the teeth on the enlarged head of the mandrel, summed expansion operations are obtained. Furthermore, a more simplified structure of the mandrel is obtained, so that a more simplified structure of the mandrel is obtained, resulting in a reduction of the cost. Furthermore, the provision of the oil vent grooves allow the radial expansion function, i.e., flow of the metal to be more reliably executed.

According to a further aspect of the present invention, an apparatus is provided, for forging a hollow rack bar from a blank metal pipe, comprising:

a die for holding the blank pipe;

a holder for a piece on which toothed portions are formed, and;

a mandrel for inserting, at a pressure, into the blank pipe held by the die, said mandrel being for forging the metal blank so that toothed portions corresponding to the shapes of the toothed portions of the die are formed on the blank pipe, thereby forming a rack bar;

said holder having an opening there-through, to which said toothed portion forming piece is embedded.

In an operation for this aspect of the present invention, the holder is provided with an opening there-through as for embedding the toothed forming piece into the holder, which is effective of obtaining an increased working precision, resulting in an increased uniformity in the load applied to the toothed die. Thus, a prolonged service life of the working tool as well as an increase precision of the toothed portions of the forged products are obtained.

Preferably, said opening for embedding the toothed portion piece has, at its ends space along the length, recessed portions of an increased radius. By this structure, a stress concentration is prevented from being occurred, resulting in an increase in the service life of the tool holder.

Preferably, the apparatus may further comprise a fluid cylinder built in the holder, said fluid cylinder being for mounting the holder to the die. The built in structure of the cylinder serves the construction to be simplified, resulting in a reduction of the cost. A seal-less structure of the built-in cylinder may generate a small amount of oil leakage. However, a finishing of a surface roughness of a proper degree can reduce the oil leakage to such a low level as low as the oil is merely oozed. On the other hand, the holder is to be used under a condition that a lubrication oil is fed. In other words, such a degree of oozing out of the oil is substantially harmless.

BRIEF EXPLANATION OF ATTACHED DRAWINGS

DESCRIPTION OF PREFERRED EMBODIMENTS

Preliminary Processing

Figure 1A:
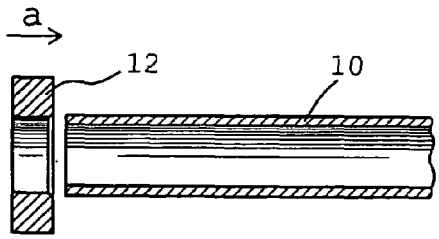
FIGS. 1A to 1E are view illustrating steps for adjusting a cross-sectional shape of a blank pipe under a swaging and ironing.
Figure 1B:
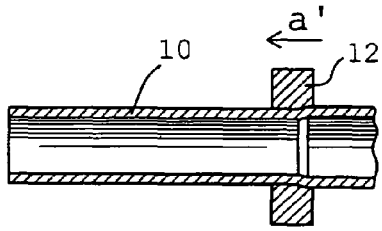
Figure 1C:
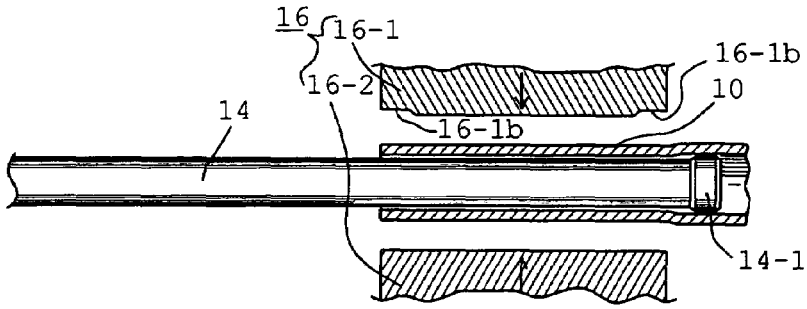

Now, a process for forming or forging a rack bar, according to the present invention, will be explained. First, blank pipes are subjected to a process for obtaining a desired cross-sectional shape. Namely, in blank pipes from steel pipe makers, outer and inner diameters of these blank pipes are largely varied in ranges of a tolerance regulated under a government regulation, such as Japanese Industrial Standard (JIS). Due to such a large variation in outer and/or inner diameters, these blank pipes are far from desired ones so long as their cross-sectional shapes are concerned, which causes a precision of products (rack bars) to be reduced on one hand, and, on the other hand, causes a service life of tools, such as a die as well as a forging mandrels to be greatly reduced. According to the present invention, a preliminary plastic deformation process including swaging and ironing is newly provided for obtaining a desired cross-sectional shape of the blank pipe. A detail of such a preliminary process will now be explained. Namely, in FIGS. 1A to 1E, a reference numeral 10 denotes a blank pipe made of steel, and 12 a die of a ring shape for a swaging. In FIG. 1A, the blank pipe 10 is held by a suitable holding means (not shown) and, then, the swaging die 12 is moved in the direction as shown by an arrow a. FIG. 2B illustrates a condition, where the die 12 has completed its designated movement, so that a reduction of an outer diameter of the blank pipe 10 to that corresponding to an inner diameter of die 12 is obtained. Then, a return movement of the die 12 in opposite direction is occurred as shown by an arrow a'. A reduction (swaging) of the outer diameter of the blank pipe is thus completed.

Figure 7A:
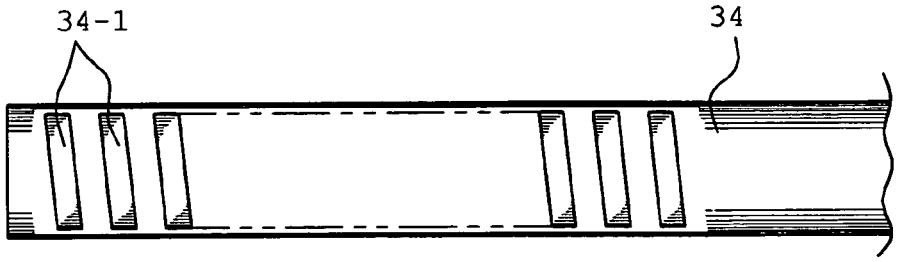
FIG. 7A is a plan view of a rack bar of a straight type as obtained according to the present invention.
Figure 7B:
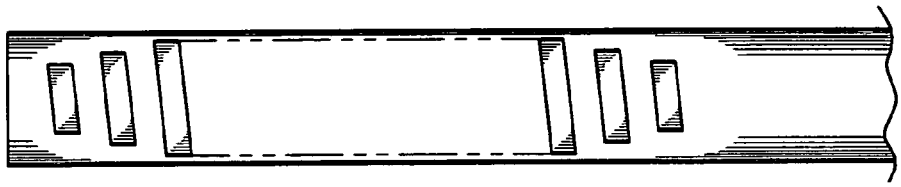
FIG. 7B is a plan view of a rack bar of a straight type in a prior art.

Next, a process for obtaining a desired cross-sectional shape, such as an irregular cross-sectional shape will be explained. In this embodiment, such an irregular shape is formed at portions of a blank pipe, corresponding to ends of a rack part in a rack bar. Namely, during a rack forging process, a rack forging mandrel is inserted to a blank pipe held by a toothed die having toothed portions. Such a mandrel insertion causes a metal to be radially expanded or flown into the toothed portions of the die, so that a rack (toothed portions) are formed on the blank pipe. However, at the ends of the die, the metal flow occurs easily in a lengthwise direction of a smaller resistance value rather than a width direction of a larger resistance value. As result, at the ends of the die, the metal flow is "escaped" axially rather than flown into the die. Thus, a flow amount of metal into the die is insufficient, which causes tooth width to be reduced at the ends of the die. In this case, a so-called ship bottom shape of toothed portion (rack) is obtained when viewed the product (rack bar) from the above as shown in FIG. 7B. In order to obviate this problem, a blank pipe is subjected to a preliminary plastic working for an adjustment of a cross-sectional shape of the blank pipe. In this embodiment in the present invention, the adjustment is such that the blank pipe is subjected to a preliminary plastic working so that an irregular cross-sectional shape is obtained at the ends of the die. The irregular cross-sectional shape of the blank pipe at the ends of the die is such that a metal flow is increased at the ends of the die, so that an evened tooth width is obtained along the entire length of the rack part of the rack bar as shown in FIG. 7A. As shown in FIG. 1C, a device for obtaining a desired irregular cross-sectional shape of the blank pipe 10 is constructed by a core rod 14 and a clamp unit 16. The clamp unit 16 is constructed by an upper half die 16-1 and a lower half die 16-2. FIG. 1C illustrates a state where an insertion of the mandrel 14 is completed. The mandrel 14 has, at its leading end, an enlarged operating head 14-1 for ironing. In FIG. 1C, the die unit 16 is in an opened condition, where the upper and lower half dies 16-1 and 16-2 are separated.

Figure 1D:
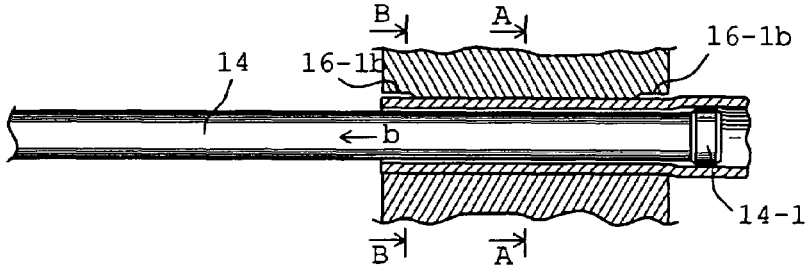
Figure 2A:
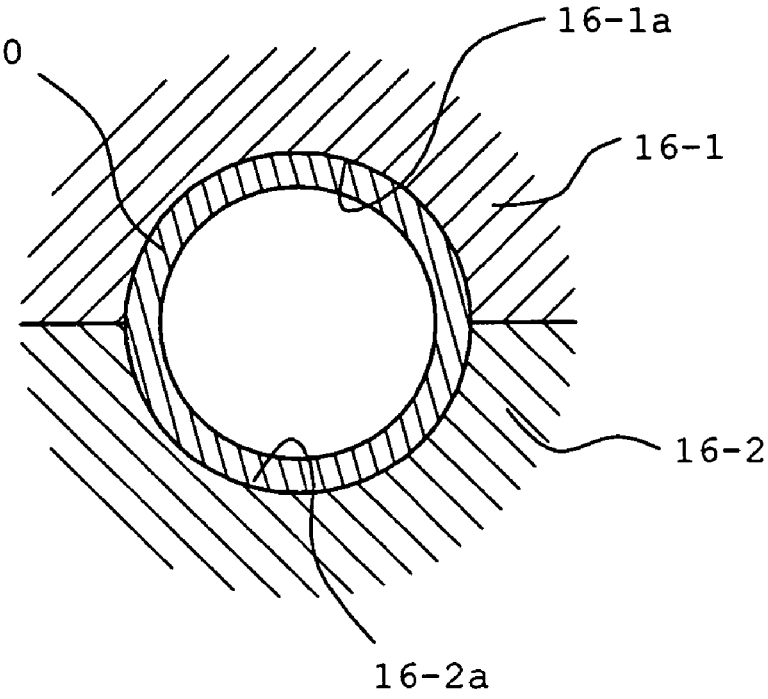
FIG. 2A is a cross-sectional shape of a blank pipe, taken along a line A-A in FIG. 1D.
Figure 2B:
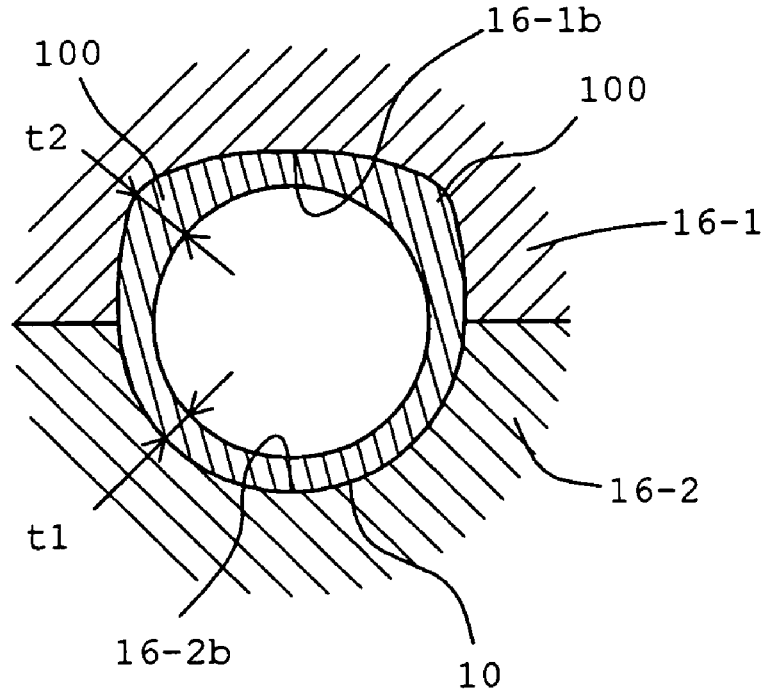
FIG. 2B is a cross-sectional shape of a blank pipe, taken along a line B-B in FIG. 1D.

From an opened condition of the die unit, a relative movement obtained between the upper and lower half dies 16-1 and 16-2, in such a manner that these half dies 16-1 and 16-2 are combined or closed as shown in FIG. 1D. At the closed condition of the die unit, the blank pipe 10 in contact with the half dies 16-1 and 16-2 is subjected to a reduction in its outer diameter. FIG. 2A illustrates cross-sectional shapes of the upper and lower half dies 16-1 and 16-2 at a middle location along the length of the die unit. As shown in FIG. 2A, both of the upper and lower half dies 16-1 and 16-2 have inner surfaces 16-1*a* and 16-2*a* of semi-circular cross-sectional shapes. These inner surfaces 16-1*a* and 16-2*a* cooperate to form a working cavity when the upper and lower dies 16-1 and 16-2 are combined. FIG. 2B illustrates cross-sectional shapes of the upper and lower half dies 16-1 and 16-2 at an end along the length of the die unit 16. As shown in FIG. 2B, the lower half die 16-2 has an inner surface 16-2*b* of a semi-circular shape. Contrary to this, the upper half die 16-1 has an inner surface 16-1*b* of an irregular cross-sectional shape. Namely, the inner surface 16-1*b* of the upper die 16-1 is recessed at upper side portions in the transverse cross-section as shown in FIG. 2B. In this embodiment, the die unit 16 has an irregular cross-sectional shape only at the ends 16-1*b* of the upper die along its length. However, it is, of course, possible that the working cavity of the die unit 16 may has irregular cross-sectional shape along the entire length of the portion of the blank pipe, which is to be subjected to the ironing process.

The ironing operation for obtaining the desired irregular cross-sectional shape of the blank pipe is commenced by withdrawing the core member 14 in the direction as shown by an arrow b in FIG. 1D. The core member 14 has a working head 14-1 of an outer diameter larger than an inner diameter of the blank pipe 10 at a location held by the clamping die unit 16. Furthermore, the working cavity of the clamp die unit 16 has, at its lengthwise ends, recessed portions 16-1*b*. As a result, during the execution of the ironing by the withdrawal of the core member 14, an increased flow of the metal is generated at the recessed portions 16-1*b*, so that an adjustment of a cross-sectional shape of a blank pipe 10 to an irregular one is done at the ends of the die 16 as shown in FIG. 2B. Namely, at the ends of the die 16, the blank pipe after subjected to the ironing process has, in its cross-section, lateral, upper shoulder portions 100 of an increased thickness t2 as shown in FIG. 2B. Contrary to this, at portions other than the ends of the die 16, the blank pipe after subjected to the ironing process (squeezing process) has a regular circular cross-sectional shape as shown in FIG. 2A. But, it is very important in the present invention that, due to the execution of the ironing process, a precise adjustment of the inner and outer diameter of the blank pipe is done even at the portions other than the ends of the die 16.

Figure 1E:
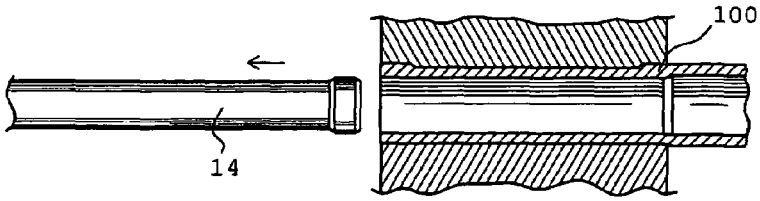

FIG. 1E illustrates a completion of the adjusting process, whereat a withdrawal of the core member 14 is completed. In FIG. 1E, the portions 100 of the increased thickness at locations of the blank pipe at the end of the clamping die 16 are also shown. Due to such an irregular a cross-sectional shape of the blank pipe 10 provided by the execution of the preliminary adjustment process, a desired tooth width is obtained even at the end of the rack during the rack forging.

The above embodiment is directed to an embodiment, wherein the blank pipe 10 at portions corresponding to ends of a rack forming die 16 is thickened for keeping a desired tooth width at the end of the rack forming die 16. However, the idea of provision of an irregularity in the cross-sectional shape of a blank pipe can also be a solution to a problem of an "escape" of metal flow occurred also at lateral ends along the tooth width direction. Namely, at a middle portion of the rack forging die, an insufficient metal flow is likely generated at lateral ends in the tooth width direction, which causes the tooth height to be reduced at the lateral ends in the tooth width direction. In order to combat this problem, a solution may be possible that a preliminary adjustment can also be done such that an irregularity in the cross-sectional shape of rack forming cavity is provided also at the middle portion of the rack forming die in the similar way as is shown in FIG. 2B. As a result of this solution, the blank pipe is locally thickened, resulting in an increased flowable amount of metal at the lateral ends in the direction of the tooth width. Due to such solution, a reduced amount of metal flow at the lateral end regions is compensated, thereby preventing a tooth height from being reduced at the lateral ends in the tooth width direction.

In short, during the execution of irregularity imparting process to the cross-sectional shape as explained above, the blank pipe 10 as firmly clamped by the clamp die 16 is subjected strongly to an ironing (squeezing) operation at its wall thickness by the mandrel 14, resulting in that a reduction of the wall thickness is occurred on one hand and, on the other hand, a degree of a surface roughness of the working surface of the clamp die 16 as well as the mandrel 14 is "transferred" to the outer surface of the blank pipe 10. Thus, a precise working is possible such that a degree of a surface roughness is as fine as 1 to 2 μm and a difference between outer and inner diameters is within a tolerance of several μm.

Main Process for Rack Bar Forging

Figure 3:
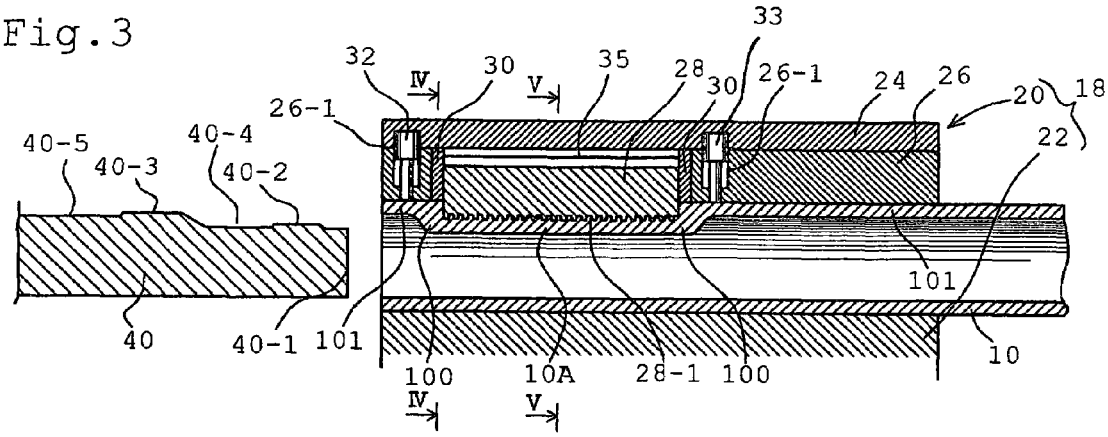
FIG. 3 is a longitudinal cross-sectional shape of a die unit for forging a rack bar from a blank pipe.
Figure 4:
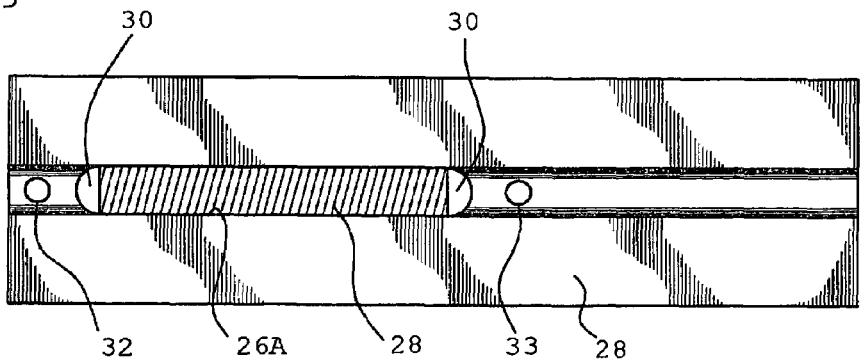
FIG. 4 is a bottom view of an upper die shown in FIG. 3.

FIGS. 3 to 7 illustrates rack forging die unit 18 from a blank pipe 10 after subjected to the preliminary adjusting process as explained above. The rack forming die unit 18 includes an upper die 20 and a lower die 22. The upper die 20 is provided with a supporting member 24, a holder 26, a toothed piece 28, a lock piece 30, and push out pins 32 and 33. The toothed piece 28 is, at its lower surface, toothed portions 28-1, which have shapes corresponding to toothed portions of rack bar to be formed on a blank pipe 10. FIG. 7A illustrates a plan view of a rack bar 34 forged from the blank pipe. The rack bar 34 to be forged from a blank pipe 10 is, in this embodiment, of a type having skewed toothed portions 34-1. Thus, as shown in FIGS. 3 and 4, the toothed piece 28 is formed with skewed toothed portions 28-1, which correspond to the skewed toothed portions of a rack bar to be forged from a blank pipe. The holder 26 is fixed to the supporting member 24 by any suitable fixing means. Furthermore, the holder 26 is formed with an axially elongated opening 26A, to which the toothed piece 28 is received. The toothed piece 28 is inserted to the opening 26A via a liner 35. Furthermore, under the condition that the toothed piece 28 is installed to the elongated opening 26A as shown in FIG. 3, the toothed portions 28-1 at the bottom of the toothed piece 28 is slightly projected from the holder 26 and the locking members 30 are struck into gaps between the toothed piece 28 and faced inner walls of the holder 26. The lock member 30 has a tapered shape, so that the striking of the lock pin 30 causes a wedging function to be generated, resulting in the toothed piece 28 to be firmly held by the holder 26. The holder 26 is formed with cylinder bores 26-1, to which the ejecting pins 32 and 33 are respectively slidably inserted. The ejecting pins 32 and 33 are extended or retracted by a selective change in the direction of introduction of a fluid pressure into the cylinder bores 26-1. Namely, an expansion of the ejecting pins 32 and 33 allows a forged article, i.e., a rack bar to be removed. Although the pins 32 and 33A are hydraulically operated ones, any sealing members can be eliminated, which makes the total system to be simplified. Some hydraulic lines for connecting the cylinder bores 26-1 with a hydraulic pressure source as well as a control valve(s) for switching a communication of the hydraulic pressure source with the cylinder bores 26-1 are needed for obtaining the desired expansion and/or retraction operation of the pins 32 and 33. However, these parts are conventional and, therefore, are not shown in the drawings for the sake of simplicity.

Figure 5A:
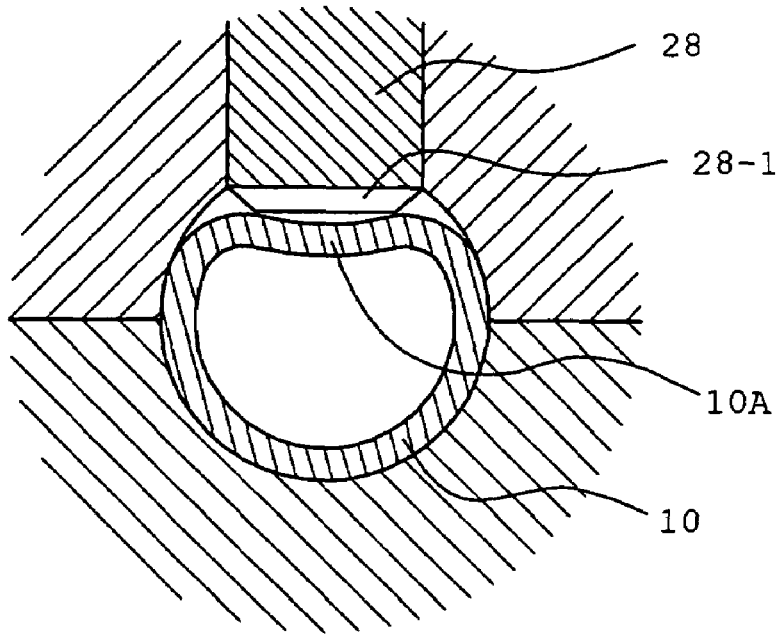
FIG. 5A is a transverse cross-sectional view of the die unit, taken along line V-V prior to the commencement of a rack forging operation from a blank pipe.
Figure 6A:
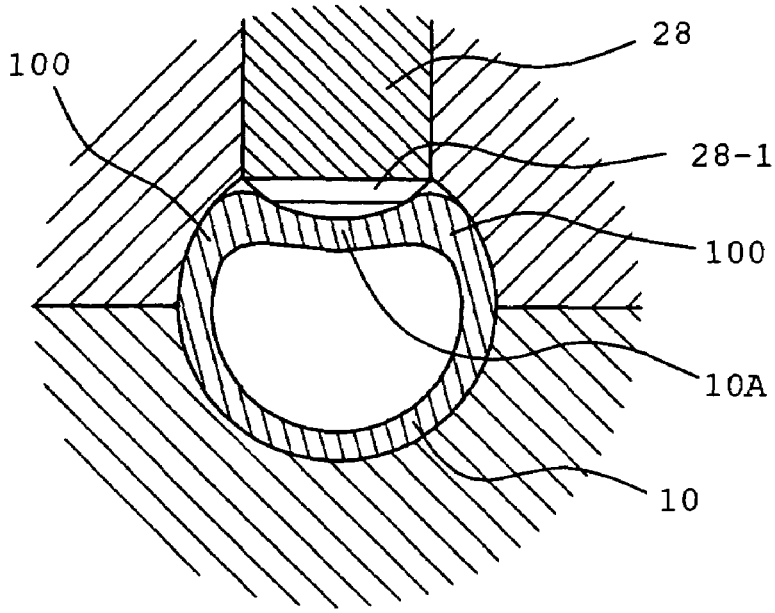
FIG. 6A is a transverse cross-sectional view of the die unit, taken along line VI-VI prior to the commencement of a rack forging operation from a blank pipe.

Prior to the execution of the rack forging operation, the upper and lower dies 20 and 22 are moved toward each other so that they are combined as shown in FIG. 3. In this combined state of the upper and lower dies, the toothed portions 28-1 at the lower end of the toothed piece 28 is contacted with the upper part of the blank pipe 10, so that the upper surface (rack forming surface) 10A of the blank pipe 10, which is in contact with the toothed portions 28-1 of the piece 28, is roughly flatly deformed as shown FIGS. 5A and 6A. As shown in FIG. 6A, the thickened portions 100 as obtained by the swaging operation during the preliminary processing are located at lateral ends of the roughly flatly pressed rack forming surface 10A.

Figure 5B:
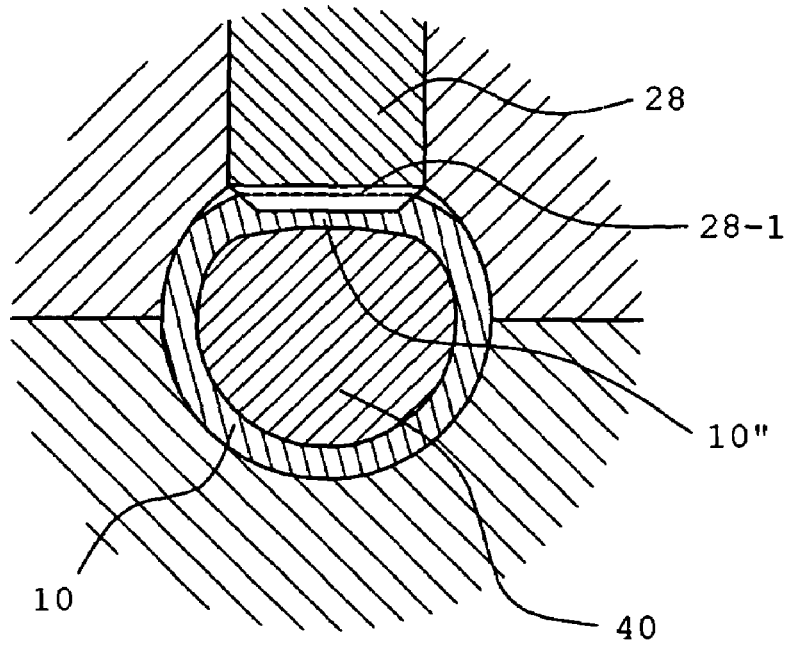
FIG. 5B is a transverse cross-sectional view of the die unit, taken along line V-V after an insertion of a mandrel to a blank pipe.
Figure 6B:
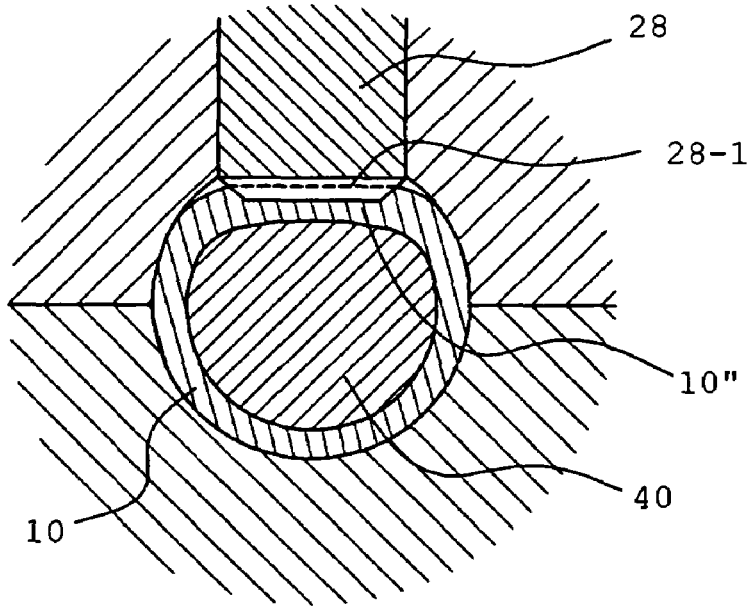
FIG. 6B is a transverse cross-sectional view of the die unit, taken along line VI-VI after an insertion of a mandrel to a blank pipe.

As shown by FIG. 3, a rack forging mandrel 40 is arranged so that it faces with the axial opening of the blank pipe 10. In FIG. 3, a rack forging mandrel 40 is only shown at the left-handed side of the die unit 18. However, as disclosed in the Japanese Un-examined Patent Publication (Kokai) No. 2001-300677, another rack forging mandrel is arranged also at the right-handed side of the die unit 18. In this construction, an alternate insertion of the mandrels between the right-handed and left-handed mandrels is done, as disclosed in this patent. As shown in FIG. 3, the mandrel 40 is provided with a guide portion 40-1 at its leading end, enlarged heads 40-2 and 40-3 of gradually increased values of working diameters, and oil grooves 40-4 and 40-5 located behind the enlarged heads 40-2 and 40-3, respectively. The working heads 40-2 and 40-3 cooperate with the portion 10A of the blank pipe 10, so that a radial flow (plastic deformation) of metal toward to toothed portions 28-1 of the piece 28 is generated, so that a forging of a rack bar from a blank pipe is done. Namely, rack teeth having shapes corresponding to those of the toothed portions 28-1 of the toothed piece 28 are forged on the blank pipe 10. FIGS. 5B and 6B illustrate conditions after the completion of the forging by the repeated insertion of the mandrel 40 to the blank pipe 10. Namely, the insertion of the mandrel 40 causes the metal to be urged radially outwardly at the upper flat part 10A of the blank pipe 10, so that the portion 10" of the metal is flown into the recesses between the toothed portions 28-1 of the die 28, resulting in a formation of rack teeth 34-1 as shown in FIG. 7A. At the middle part as shown in FIG. 5A, a relatively uniform flow of the metal long the tooth width direction, resulting in a formation of teeth of desired width. However, at the ends of the rack forging die 18 (axial ends of the rack forming surface 10A of the blank pipe 10), an escape of the metal flow is apt to be generated, which causes the tooth width to be reduced. As a result, in a prior art, a rack portion of a "ship bottom" shape is apt to be produced, wherein the tooth width is large at the center portion and is small at axial ends. According to the present invention, a blank pipe 10 is subjected to a preliminary step for an adjustment of cross-sectional shape at portions of the blank pipe corresponding to axial ends of the toothed portion 28-1 of the die 16, in such a manner that the thickness of the blank pipe 10 is increased at the lateral ends 100 of the upper part of the blank pipe in the direction of the tooth width. As a result, when an insertion of the mandrel 40 is done, an increased flow amount is obtained at the ends of the upper part of the blank pipe, so that a product (rack bar) of a uniformed width of the toothed portions along the entire length of the rack is obtained as shown in FIG. 7A.

As explained above, during the forging by an expansion for the inner diameter side by a mandrel, axial ends of the toothed part of a rack forging die in the axial direction become "opened" portions of reduced metal flow resistance, whereat an escape of a metal flow is likely, resulting in a reduction of a flow amount of metal to the rack forging die 18. According to this aspect of the invention as explained above, a preliminary plastic deformation process (FIGS. 1A to 1E) for obtaining an irregular cross-sectional shape is done in such a manner that an wall thickness is locally increased at the end portions 100 along the width. Namely, at the upper, lateral end portions 100, the wall thickness has an increased value $t_2$ in comparison with the wall thickness of $t_1$ at a location other than the portions 100. As a result of this solution of a processing for obtaining the irregular cross-sectional shape prior to the forging process, a forging process under a single die is sufficient to obtain a desired tooth width at the opened part, irrespective of a large amount of an escape of the metal. Furthermore, in the rack bar forging, the die 18 has opened parts at lateral ends of the toothed portions of the die, whereat an escape of the metal is also apt to be generated. In the latter case, a blank pipe is subjected to a process for obtaining locally thickened parts (irregular cross-sectional shape) at positions of the blank die, which correspond to the lateral ends of the toothed part of the die. In short, according to the solution of the present invention, prior to the rack forging process, the blank pipe is subjected to a process for adjustment of wall thickness at locations where an escape of the metal during forging process is likely. As a result, at a subsequent rack forcing process, a desired or compensated flow of the metal to the die (toothed portion of the die) is obtained even at the locations, where an escape of metal flow is likely. Due to the locally increased wall thickness, a relative increase in a flow resistance to the die is compensated, thereby keeping desired tooth thickness. A prior art solution of a provision of plurality of mandrels of irregular shapes is not effective to combat a problem of the above mentioned escape of metal flow in the longitudinal direction. The present invention makes it possible to combat not only to a problem of an escape in a tooth width direction but also to a problem of an escape in an axial direction.

Figure 8:
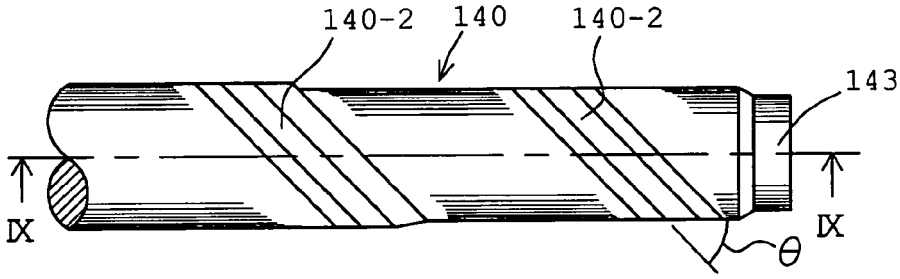
(Prior Art) Fig.8
FIG. 8 is a plan view of a mandrel for forging a rack bar according to another embodiment of the present invention.
Figure 9:
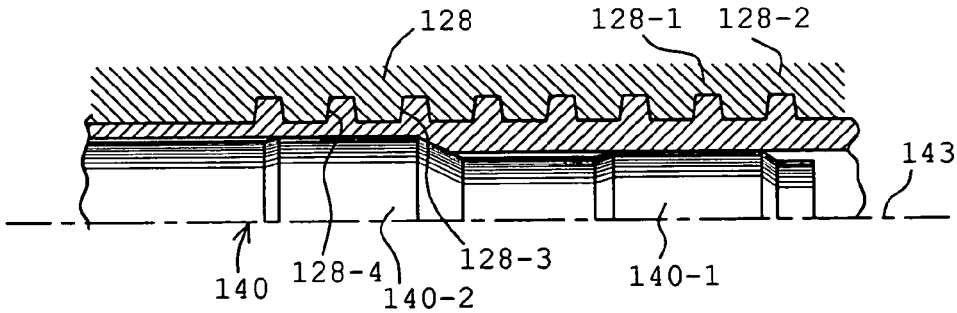
FIG. 9 is a longitudinal cross-sectional shape taken along a line IX-IX in FIG. 8.

FIGS. 8 and 9 illustrate another embodiment of a rack forging mandrel according to the present invention. In this embodiment, a mandrel 140 is formed with enlarged or operating heads 140-1 and 140-2, which are extend in a direction inclined with respect to an axial line 143. The angle of the inclination of the enlarged heads 140-1 and 140-2 are shown by θ. Thanks to such an inclined arrangement, a simultaneous expansion operation, i.e., a flow of the metal to the toothed piece 128 to a plurality of adjacent toothed grooves by a single working head 140-1 or 140-2 is realized. FIG. 9 illustrates a condition that an expansion (flow of metal) is done by the first enlarged head 140-1 toward adjacent grooves 128-1 and 128-2 and that an expansion is also done by the second enlarged head 140-2 toward adjacent grooves 128-3 and 128-4. By such a simultaneous expansion operation to adjacent grooves 128-1 and 128-2 or 128-3 and 128-4 by the single enlarged head 128-1 or 128-2, a load generated in the toothed die 128 by the mandrel 140 is localized and reduced, resulting in an increased service life of the working tools, that are the mandrel and the toothed die.

Figure 10:
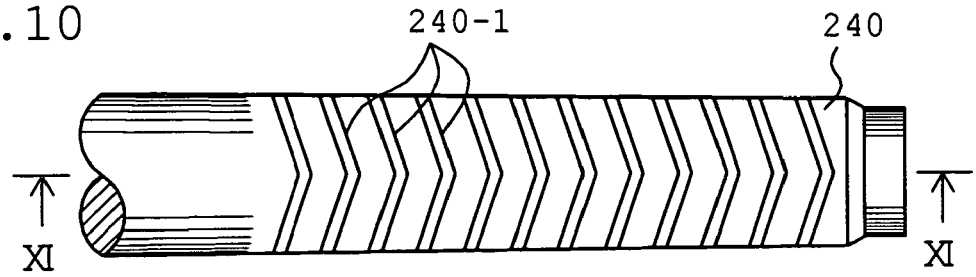
FIG. 10 is a plan view of a mandrel for forging a rack bar according to further another embodiment of the present invention.
Figure 11:
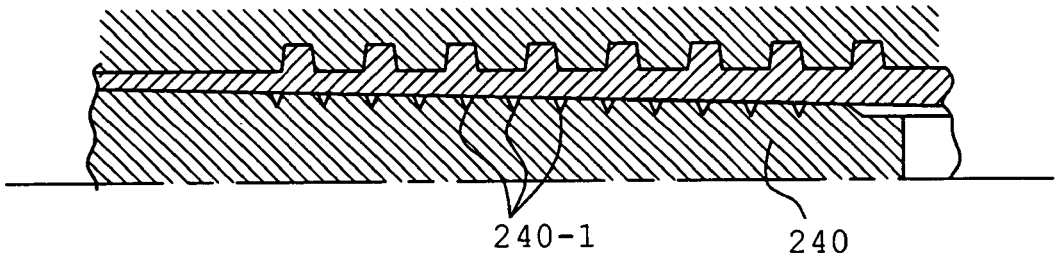
FIG. 11 is a longitudinal cross-sectional shape taken along a line XI-XI in FIG. 10.

FIGS. 10 and 11 illustrate a mandrel 240 in another embodiment. The mandrel 240 is of sloped type and is provided with a gently inclined operating head, on which a multiply of parallel grooves 240-1 is formed, each of which grooves is angled toward the leading end of the mandrel. As a result of this structure of the mandrel 240, a multiplied engagement of a number of stages of 4 to 6 or more is obtained, resulting in a more smoothed movement of the load. Namely, single contingent sloped surface of this embodiment makes it possible to obtain an expansion amount, which corresponds to that as obtained by 4 to 6 enlarged heads. Furthermore, the angled oil grooves can be easily provided by a later machining process, which makes the production cost of the mandrel to be reduced. Such a reduction of cost is desirable since a multiplied mandrel system of number of mandrels around 10 is usually employed. In place of the angled grooves 240-1, mere parallel inclined grooves can also be employed.

The invention claimed is:

1. A method for forging a hollow rack bar from a blank pipe made of metal, comprising:

(a) subjecting the blank pipe to a plastic deformation process for an adjustment of an inner diameter and an outer diameter of the blank pipe along an entire periphery of the blank pipe;

(b) subjecting a predetermined outer part of the blank pipe to a flattening process to substantially flatten the predetermined outer part;

(c) holding said blank pipe after the plastic deformation process and the flattening process by a die having a toothed portion so that the toothed portion is contacted with the predetermined outer part of the blank pipe; and (d) inserting, under a pressure, a mandrel into the blank pipe held by the die for causing the metal to be flown toward the toothed portion, thereby forming on the predetermined outer part of the blank pipe another toothed portion having a shape corresponding to a shape of the toothed portion of the die, wherein the step (a) for subjecting the blank pipe to the plastic deformation process comprises subjecting the blank pipe to a swaging process for reducing the outer diameter of the blank pipe, and subjecting the swaged blank pipe to an ironing process for producing a desired cross-sectional shape of the blank pipe.

2. A method for forging a hollow rack bar from a blank pipe made of metal, the method comprising a pre-forming step and a main forming step after the execution of the pre-forming step, the pre-forming step comprising:

(a) subjecting the blank pipe to a swaging process for reducing an outer diameter of the blank pipe;

(b) clamping the swaged blank pipe by a clamping die of a desired shape at an outer periphery thereof, while locating a working core inside the blank pipe; and (c) withdrawing the working core to expand the blank pipe in order to generate a desired shape of a hollow cavity of the blank pipe expanding in an axial direction and a radial direction;

said main forming step comprising:

(d) holding the pre-formed blank pipe from its outer side by a rack forming die having a toothed portion; and (e) inserting a mandrel to the hollow cavity of the blank pipe, thereby forming on an outer surface of the blank pipe another toothed portion having a shape corresponding to a shape of the toothed portion of the rack forming die.

3. A method according to claim 2, further comprising:

forming in a cavity of a recess of the clamping die at locations corresponding to locations of the blank pipe corresponding to the ends of rack portion of the product to be forged from the blank pipe; and obtaining a flow of excessive material as generated during the swaging into said recess, thereby obtaining irregular cross section at said locations of the blank pipe.

* * * * *